US007487604B2

(12) United States Patent
Perron, Jr.

(10) Patent No.: US 7,487,604 B2
(45) Date of Patent: Feb. 10, 2009

(54) SOCCER SHOE COMPONENT OR INSERT MADE OF ONE MATERIAL AND/OR A COMPOSITE AND/OR LAMINATE OF ONE OR MORE MATERIALS FOR ENHANCING THE PERFORMANCE OF THE SOCCER SHOE

(76) Inventor: J. Edward Perron, Jr., 3528 Shellie St., Metairie, LA (US) 70002

( * ) Notice: Subject to any disclaimer, the term of this patent is extended or adjusted under 35 U.S.C. 154(b) by 215 days.

(21) Appl. No.: 11/096,109

(22) Filed: Mar. 31, 2005

(65) Prior Publication Data

US 2005/0235527 A1 Oct. 27, 2005

Related U.S. Application Data

(63) Continuation-in-part of application No. 10/660,119, filed on Sep. 11, 2003, now abandoned.

(60) Provisional application No. 60/557,869, filed on Mar. 31, 2004, provisional application No. 60/502,002, filed on Sep. 11, 2003, provisional application No. 60/409,386, filed on Sep. 11, 2002, provisional application No. 60/409,383, filed on Sep. 11, 2002.

(51) Int. Cl.
*A43B 23/00* (2006.01)

(52) U.S. Cl. ..... 36/107; 36/102; 36/43; 36/108; 36/30 R

(58) Field of Classification Search ..... 36/43, 36/44, 102, 103, 128, 107, 108, 30 R, 31, 36/77 R See application file for complete search history.

(56) References Cited

U.S. PATENT DOCUMENTS 4,155,180 A 5/1979 Phillips
4,454,662 A 6/1984 Stubblefield
4,506,460 A 3/1985 Rudy
4,651,445 A 3/1987 Hannibal
4,854,057 A 8/1989 Misevich et al.
4,858,338 A 8/1989 Schmid
5,024,007 A 6/1991 DuFour
5,025,573 A 6/1991 Giese et al.
5,035,069 A 7/1991 Minden
5,052,130 A 10/1991 Barry et al.
5,142,797 A 9/1992 Cole, III
5,179,791 A 1/1993 Lain
5,203,793 A 4/1993 Lyden (Continued)

*Primary Examiner*—Marie Patterson
(74) *Attorney, Agent, or Firm*—Garvey, Smith, Nehrbass & North, L.L.C.; Seth M. Nehrbass; Charles C. Garvey, Jr.

(57) ABSTRACT

An insert for soccer shoes absorbs and store energy from the foot at foot-strike and return some of this energy to the object being struck. The insert may also cushion the foot, leg and body; provide foot stability and motion control; reduce fatigue; extend the float time of a runner and increase the jump height of the wearer. The insert is intended to absorb, store and return energy to the object struck, which would otherwise lost using the existing shoe components and inserts. The insert preferably extends around the periphery of the front of the shoe and extends longitudinally as well from the front of the shoe towards the back of the shoe, at least to about the middle of the shoe, and preferably proximate the heel of the shoe. The insert preferably also extends vertically.

19 Claims, 5 Drawing Sheets

U.S. PATENT DOCUMENTS

| | | | |
|---|---|---|---|
| 5,452,526 | A | 9/1995 | Collins |
| 5,572,804 | A | 11/1996 | Skaja et al. |
| 5,695,850 | A | 12/1997 | Crow |
| 5,720,118 | A | 2/1998 | Mayer et al. |
| 5,960,566 | A | 10/1999 | Brown |
| 6,120,880 | A | 9/2000 | Crow |
| 6,145,221 | A | 11/2000 | Hockerson |
| 6,158,150 | A | 12/2000 | Morris et al. |
| 6,199,303 | B1 | 3/2001 | Luthi et al. |
| 6,205,683 | B1 | 3/2001 | Clark et al. |
| 6,438,873 | B1 | 8/2002 | Gebhard et al. |
| 6,470,599 | B1 | 10/2002 | Chu |
| 6,485,661 | B1 | 11/2002 | Brown |
| 6,708,427 | B2 | 3/2004 | Sussmann et al. |
| 6,745,501 | B2 | 6/2004 | Brown |

SOCCER SHOE COMPONENT OR INSERT MADE OF ONE MATERIAL AND/OR A COMPOSITE AND/OR LAMINATE OF ONE OR MORE MATERIALS FOR ENHANCING THE PERFORMANCE OF THE SOCCER SHOE

CROSS-REFERENCE TO RELATED APPLICATIONS

All of my prior patent applications are incorporated herein by reference, including my U.S. patent application Ser. No. 10/660,119, filed 11 Sep. 2003, my U.S. Provisional Patent Application Ser. No. 60/557,869, filed 31 Mar. 2004, my U.S. Provisional Patent Application Ser. No. 60/502,002, filed 11 Sep. 2003, and my U.S. Provisional Patent Application Ser. Nos. 60/409,383 and 60/409,386, both filed 11 Sep. 2002.

Priority of my U.S. Provisional Patent Application Ser. No. 60/557,869, filed 31 Mar. 2004, is hereby claimed.

In the US, this is a continuation-in-part of my U.S. patent application Ser. No. 10/660,119, filed 11 Sep. 2003, now abandoned.

BACKGROUND OF THE INVENTION

1. Field of the Invention

The present invention relates to the field of performance enhancing shoe components or inserts for use in conjunction with various types of foot-ware. More particularly, the present invention relates to the field of performance enhancing shoe components or inserts which absorb and store energy of local loads and forces, through elastic deformation, and then return the energy to the shoe wearer, or to an object struck by a shoe, in useful form as the load is removed.

2. General Background of the Invention

There is a high demand for athletic equipment which enhances the performance of athletes. At all levels of athletic competition, small improvements in performance can be the difference between success and failure. At the highest levels of athletics, the difference of a few tenths or hundredths of a second is all that separates the elite athlete from the ordinary. For this reason, equipment which improves performance even slightly, will be desired in high demand. The newer materials used in tennis racket construction or golf club shafts are examples of equipment which improves performance by absorbing and storing energy, then returns this energy in a useful form as the load is removed.

This high demand for performance enhancing athletic equipment includes the art of athletic shoes and shoe components. Most recent improvements in athletic shoes or athletic shoe components have been made for aesthetic reasons or for comfort or to reduce weight. Few changes in athletic shoes or their components have been for meaningful increases in athletic performance. Present athletic shoes and their components fail to provide an energy return to the wearer. Neither do they absorb energy and return energy to a ball or object struck by the shoe. Description of Prior Art Athletic shoes typically comprise a fabric, leather or synthetic upper, an outsole including a treaded or cleated lower surface, and a midsole positioned between the outsole and the foot of the wearer. There may also be an insole positioned between the outsole and the foot of the wearer. If the shoe is not manufactured with an insole, a wearer may add an insole or replace the midsole with an insole.

The midsole of a conventional athletic shoe is generally formed from a flexible, resilient, relatively soft material in order to absorb shock that results from impact of the shoe with the ground. A typical outsole is made of a higher density, tougher, more rigid material in order to protect the shoe from degradation and to support the foot. The outsole must also be flexible in order to facilitate ease of movement of the foot during certain athletic motions.

The following US Patents are incorporated herein by reference:

| | |
|---|---|
| U.S. Pat. Nos.: | 4,454,662, 4,506,460, 4,858,338 5,025,573 5,052,130 5,179,791 5,203,793, 5,452,526, 5,572,804, 5,695,850 5,960,566, 6,120,880, 6,145,221 6,205,683, 6,485,661. |

U.S. Pat. No. 5,572,804 discloses an inner sole for an athletic shoe that can have many degrees of stiffness, by the application of multiple inserts into the sole.

U.S. Pat. No. 5,452,526 discloses a soccer shoe with an outsole stiffener; the stiffening inserts are molded into the outer sole.

U.S. Pat. Nos. 6,120,880 and 5,694,850 disclose placing inserts into various portions of the insole of an athletic shoe to enhance performance.

U.S. Pat. No. 6,205,683 discloses placing a torsional insert within the inner sole of an athletic shoe.

U.S. Pat. No. 4,454,662 of 1984 issued to Stubblefield adds stiffening components to the arch and heel portions of the shoe. The present invention adds flexible components to just the front or to the front and outside edges of the shoe. The present invention may provide some measure of arch support, but little or no heel support. The shoe/sole/insert of an embodiment of the present invention will have a shape, location and function significantly different than the stiffening components in this patent.

There are numerous articles of footwear in the prior art in which inserts and shoe components are present in order to provide comfort, stability or support for the foot. For example, U.S. Pat. No. 4,506,460 of 1985 issued to Rudy describes moderators and stabilizers located under the forefoot and heel. The purpose of these moderators and stabilizers is to cushion shock forces, provide improved support, control and stability, store energy and return energy to the wearer. These moderators and stabilizers are located under and vertically alongside the forefoot and heel of the wearer. The present invention's primary location will be the toe of the shoe with little or nothing supporting the heel and forefoot. The shoe/sole/insert of embodiments of the present invention preferably have both horizontal and vertical components, with the vertical component only at the toe end of the shoe. The horizontal component of the shoe/sole/insert of embodiments of the present invention can differ in shape and location within the shoe.

U.S. Pat. No. 5,452,526 of 1995 issued to Collins describes a two-part stiffener, the first portion of which stiffens the waist or shank of the outsole; and the second portion both stiffens and provides resiliency to the forepart of the of the outsole. The purpose of this two-part stiffener is to provide physical properties which are selected for the appropriate use of the shoe and to provide comfort to the wearer. These stiffeners operate to stiffen the shank or waist of the outsole and a fore part of the outsole in response to transverse flexure of the user's foot at the ball of the foot. These stiffeners are relatively complex in shape and located in various places throughout the outsole and arranged in a manner to resist flexure about the longitudinal axis of the shoe. The shoe/sole/insert of embodiments of the present invention preferably provide resilience primarily in response to vertical flexure of the user's foot at the toe, or even in front of the toe, and to a lesser extent, in response to some transverse flexure only at the outside edge of the foot. The shoe/sole/insert of embodiments of the present invention preferably have relatively simple shapes with a location farther forward and whose function is not lateral support, but a vertical return to its original shape.

U.S. Pat. No. 5,572,804 issued to Skaja et al. in 1996 details method of construction of shoe midsole components from a flexible high polymer resin. These shoe sole components are formed from two sheets of thermoplastic resin, with each sheet consisting of different materials having different properties and containing varying shapes and sizes of support members. These support members comprise inwardly directed indentations in each sheet of the thermoplastic resin which must be precisely aligned with the matching indentation. The shoe/sole/insert of embodiments of the present invention will not be restricted to only the midsole, nor will it consist of a plurality of shaped protrusions scattered throughout the midsole component material. The horizontal component of the present invention can preferably be a thin, flat or slightly curved object consisting of a single or very few individual sizes and shapes extending to the front and side edges of the shoe outsole or midsole or inserted insole. Only if the present invention is hollow will it be important to more precisely match various protrusions or indentations.

U.S. Pat. No. 5,695,850 issued to Crow in 1997 is a performance shoe component consisting of 1,4-polybutadiene and a natural or synthetic rubber. This shoe component is most advantageously placed beneath the ball of the foot. The purpose of that location is to improve the wearer's ability to leap higher or run faster or provide cushioning. The horizontal component of the shoe/sole/insert of embodiments of the present invention will be most advantageously placed under and possibly beyond the front edges and outside edges of the shoe. The vertical component of the shoe/sole/insert of embodiments of the present invention are preferably most advantageously placed on top of, or directly above, the horizontal component. This location is intended to maximize the absorption of energy and to return a portion of this energy to the object struck.

U.S. Pat. No. 5,960,566 issued to Brown in 1999 and U.S. Pat. No. 6,485,661 issued to Brown in 2002 both consist of a composite material orthotic insert configured to enhance control over the motions of the foot within the shoe. The stated purpose of the insert is to control the movements of certain joints of the foot during walking and running. This orthotic insert is positioned under the heel and forefoot. The shape and position of the insert and its purpose in the aforementioned patent is clearly distinguishable from the shoe/sole/insert of embodiments of the present invention.

U.S. Pat. No. 6,120,880 issued to Crow in 2000 is a continuation of U.S. Pat. No. 5,695,850. The characteristics which distinguish the present invention from this patent are the same as those outlined above.

U.S. Pat. No. 6,205,683 issued to Clark et al. in 2001 is for an insole board which includes a shock diffusion plate located under the heel and midfoot. The location, shape and purpose of the shoe/sole/insert of embodiments of the present invention are clearly distinguishable.

U.S. Pat. No. 4,858,338 discloses an insert for a shoe sole, which includes an elastic strip, which absorbs and stores the energy of running and returns the energy to the wearer.

U.S. Pat. Nos. 5,025,573 and 5,179,791 disclose a composite shoe bottom with layers of firm and softer materials, which provide firm support and lateral stability.

U.S. Pat. No. 5,052,130 discloses a spring plate made of multiple layers of carbon fiber embedded in a polymer which stores and releases energy in a manner beneficial to a runner.

U.S. Pat. No. 6,145,221 discloses a cleated athletic shoe incorporating a cleat frame which supports the cleats in a manner which transfers upward forces from the cleat into the cleat frame when the shoe is weighted.

U.S. Pat. No. 5,720,118 issued to Mayer in 1998 provides an inlay for a shoe. The inlay comprises one piece of a hard material, preferably selected from metal, plastic, steel and spring steel. The stated purpose of this inlay is to reduce the risk of lateral snapping over of the foot, thus reducing the risk of ligament tears and strains. Another stated purpose is to protect the bottom of the foot from right angle pressures by distributing over the entire inlay pressures caused by small stones or uneven ground. This patent further describes a toe cap riveted to the inlay. This cap is made of spring steel; its stated function is to protect the toes and forefoot from falling objects.

The preferred embodiment of the present invention also consists of a horizontal and vertical component. An embodiment of the present invention has the vertical component forming a toe cap. Although the horizontal component may be made of metal, plastic or steel, the vertical component should be made of a softer, more energy absorbent material. The purpose of the vertical component in the present invention is not to protect the toes and forefoot from falling objects; rather, it is to transmit energy to the horizontal component so that both components working together will return more energy to the object struck by the wearer. The vertical component need not be riveted or otherwise attached to the horizontal component. It can fulfill its function merely by being placed directly above the horizontal component.

There are numerous articles of footware in the prior art in which inserts and shoe components are present in order to provide comfort, stability or support for the foot. The purpose of these moderators, stabilizers and orthotics is to cushion shock forces, provide improved support, control and stability, store energy and return energy to the wearer. An essential difference between the prior art and the preferred embodiments of the present invention is the vertical component. The vertical component is preferably located at the toe end of the shoe, and it will preferably rest upon the horizontal component, or be located directly above the horizontal component. The vertical component may be permanently attached to the horizontal component, or it may be manufactured as a separate piece and later attached to the horizontal component or placed above the horizontal component. The vertical component may be used without the horizontal component, it may be used an insert resting upon or located above the midsoles and/or outsoles of the prior art. The prior art primarily serves to provide comfort and stability to the wearer, or to increase the return of energy to the wearer. The primary purpose of embodiments of the present invention is to increase the return of energy to the object struck by the wearer.

The shoe/sole/insert of embodiments of the present invention preferably provide resilience primarily in response to vertical flexure at the toe, or in front of the toes of the foot of the wearer. To a lesser extent there may also be resilience in response to vertical flexure at the inside and outside edges of the forefoot. The shoe/sole/insert of embodiments of the present invention may have relatively simple shapes. The horizontal component can preferably be thin and flat or slightly curved objects consisting of individual sizes and shapes extending to the front and side edges of the shoe outsole or midsole or inserted insole.

A primary characteristic of the shoe/sole/insert of embodiments of the present invention, which distinguishes the present invention from most other patents incorporated by reference, is that of the vertical component. This vertical component preferably rests upon the horizontal component, or if not directly upon the horizontal component, the vertical component is located above the horizontal component. In order to increase the elastic deformation of the horizontal component of the shoe/sole/insert of embodiments of the present invention, in certain types of kicks or other uses of the shoe, the vertical component will be the first portion of the shoe/sole/insert to make contact with the object struck. In making contact with the object, this vertical component will absorb and transfer more energy to the horizontal component of embodiments of the present invention, which would return more energy to the object struck by the shoe, than would be possible without the vertical component. If the vertical component is not present, the foot inside of the shoe would make contact with the object struck before the horizontal component could make contact. The foot in such case would absorb some portion of the energy created in striking the object and could only transfer the unabsorbed energy to the horizontal component of embodiments of the present invention. The less energy transferred to the horizontal component, the less the horizontal component can be flexed, and the less the horizontal component is flexed, the less energy the horizontal component can transfer to the object struck, or to the wearer of the shoe.

The vertical component of the shoe/sole/insert of embodiments of the present invention will produce a more efficient transfer of the energy produced by the physical act of striking the object, back to the object struck. When a foot inside of a shoe without the shoe/sole/insert of embodiments of the present invention makes contact with the object struck, the foot acts as a type of energy sponge situated between the object struck and the horizontal component of embodiments of the present invention. The energy absorbed by the foot will be transferred to the bones, ligaments, tendons and muscles of the foot and leg. This absorbed energy will be felt in the foot and leg as heat. The more heat absorbed by the bones, ligaments, tendons and muscles of the foot and leg, the more fatigue and discomfort will be felt by the wearer of the shoe.

BRIEF SUMMARY OF THE INVENTION

The prior art does not anticipate the basic concepts of the present invention. The present invention will absorb and store energy from the foot at foot-strike and return some of this energy to the object being struck. The present invention, incidentally, may also cushion the foot, leg and body; provide foot stability and motion control; reduce fatigue; extend the float time of a runner and increase the jump height of the wearer. The present invention is intended to absorb, store and return energy to the object struck, which would otherwise be lost using the existing shoe components and inserts.

The horizontal component of embodiments of the present invention can comprise essentially a light-weight flat, or slightly curved, thin unitary object made of a flexible material or materials, which can be integrated into a shoe's outsole and/or midsole and/or insole. The object may extend from the heel or arch of the foot to or beyond the toes of the foot. The vertical component of the embodiments of the present invention will either rest upon, or be directly above the horizontal component; the vertical component of the object may even curve over the toe, producing a cap, which extends beyond and over the top of the toes. The horizontal and vertical components of the embodiments of the present invention may take various shapes dependent upon the wearer's preferences and intended use.

The shape of the vertical component of the shoe/sole/insert of embodiments of the present invention will be determined by the material or materials used in its manufacture, and the particular performance characteristics desired by the wearer of the shoe. The materials used, the shapes of the shoe/sole/inserts of embodiments of the present invention, and the location of the vertical components upon or above the horizontal components will also be dictated by concerns for safety. The Federation Internationale De Football Association (FIFA) in law 4 states that players must not use equipment or wear anything that is dangerous to himself or to other players. The vertical component should be made of a material or materials that are stiff enough to efficiently store the energy produced by the act of kicking an object and transfer that energy to the horizontal component. The material or materials making up the vertical component must also be flexible and soft enough to be used safely in the game played by the wearer. One example of a material which provides a high energy return is 1,4-polybutadiene. This material can be used in combination with other high energy return rubbers such as natural rubber, synthetic isoprene rubber, polyisoprene, butadiene acrylonitrile rubber and/or ethylenepropylene diene modified rubber.

The object of the present invention is to provide a vertical component of a soft, high energy return material which also provides shock absorption. It is a feature of the invention that the vertical component be compressible by the human foot to maximize energy return. Another feature of the present invention is that the vertical component transfer energy to a stiffer, and probably harder, horizontal component so that both components working together transfer energy to the object kicked by the wearer.

In order to accommodate this vertical component, the conventional soccer shoe may have to be modified. The location of the vertical component beyond the toes of the foot, rising vertically above the toes, and laterally back towards the heel on each side of the toes and forefoot would require a larger toe box than is now present in conventional soccer shoes. The length of the soccer shoe may also be a size or a number of sizes longer than the wearer customarily would wear. This additional length would also increase the size of the arc of the shoe through space as the foot is flexed before contacting the ball, and then extended through the ball in the follow through after contacting the ball.

The intent of the present invention is to provide shoe components which impart energy into the object struck. It is a feature of some embodiments of the present invention that it be placed as far forward and/or laterally as reasonable, in order that the ability to effectively use the shoe for purposes other than striking the object, is not significantly compromised.

The intent of the shoe component of the present invention is that a struck object travel faster and/or further than would be possible without this shoe component. Placing the present invention at the farthest end of the arc of the kicking leg and foot would consequently enable the maximum amount of absorption of energy by the component of the present invention. The more energy absorbed, the more energy would be available to transfer to the struck object.

The embodiments of the present invention may also provide more comfort to the wearer. Energy absorbed by the present invention will decrease the energy absorbed by the bones, muscles, joints, ligaments and tendons of the toes, leg and foot. This would reduce physical fatigue and/or pain.

Using the present invention's energy return characteristics may also increase the ability of the wearer to jump higher, or to run faster by increasing the wearer's stride length. These shoe components may improve athletic performance in a variety of athletic endeavors.

The material or materials used in the manufacture and the shape or shapes of the present invention and the location of the present invention within the shoe may be varied depending upon the wearer's intended use. Specific applications may include increased comfort and foot stability, better motion control, an increase in energy efficiency, a decrease in fatigue and risk of injury and many other desired advantages.

The primary material for the horizontal components of embodiments of the present invention will preferably be a high tensile material such as graphite and carbon. A ratio of 10% carbon to 90% graphite will be stiffer than a ratio of 20% carbon to 80% graphite. The graphite fibers may be unidirectional, on a bias, or woven. The present invention may be 100% carbon or 100% graphite, or some combination of the two; this material or these materials may be laminated or combined with another material or other materials. There may be no graphite or carbon in the components of the present invention, but one or both of these are the primary materials used in the shafts of modern golf clubs and tennis rackets. The technology which has been recently been employed to increase the distance a golf ball travels when struck with the newer golf clubs; or the increase in velocity of a tennis ball struck by the newer tennis rackets, is a technology which can be used with the present invention. Other materials used in tennis rackets include kevlar, fiberglass and titanium. Golf club shafts are usually graphite or metal. The graphite, titanium and metal may be alloys. The components of the present invention can be made of the material or combinations of materials, whether in composite or laminate form, used in the construction of newer models of tennis rackets and golf club shafts.

The primary material or materials for the vertical component of embodiments of the present invention will preferably be a natural or synthetic rubber compound similar to that found in the outsole of tennis, basketball and cross training shoes. These compounds may include, but not limited to, combinations of 1,2-polybutadiene, 1,4-polybutadiene, synthetic isoprene rubber, natural rubber, polyisoprene, butadiene acrylonitrile rubber, ethylenepropylene diene modified rubber, styrene butadiene rubber, thermoplastic elastomers, and plastics such as polystyrene, ethylene vinyl acetate and polyvinyl chloride. The vertical component can be about as high as the front of the shoe in which it is to be inserted. It is preferably at least 50% as high as the front of the shoe in which it is to be inserted, more preferably at least 75%, even more preferably at least 90%, and most preferably at least 95% as high as the front of the shoe in which it is to be inserted. For example, for a relatively standard size soccer shoe (around US size 10, around European size 42, the vertical component is preferably at least 1 cm high, more preferably at least 1.5 cm high, even more preferably at least 2 cm high, and most preferably at least 2.5 cm high (all as measured from the inside of the sole of the soccer shoe). The vertical component can be about 0.10-2.0 cm thick, more preferably about 0.15-1.50 cm thick, even more preferably about 0.20-1.0 cm thick, and most preferably about 0.25-0.80 cm thick. For example, it can be about 0.50 cm thick.

The horizontal component can be about 0.01-2.0 cm thick, more preferably about 0.05-1.75 cm thick, even more preferably about 0.10-1.50 cm thick, and most preferably about 0.20-1.0 cm thick. For example, it can be about 0.50 cm thick.

The present invention includes a performance enhancing shoe components for a soccer shoe, the soccer shoe comprising a shoe upper and at least a sole secured to the upper such that a wearer's foot is positioned within the upper and above the sole, which incorporates one or more preformed objects embedded in an outsole body, or which constitutes the entire outsole; the horizontal and vertical components of embodiments of the present invention will operate to deflect, without permanent deformation, in response to an applied load creating a deflecting stress and then to return to its original shape upon removal of the applied load causing the deflecting stress, the horizontal and vertical components of the present invention operating to absorb, redistribute and store the energy of localized loads applied thereto through deflection and, by returning to its original shape, to return energy to the wearer and/or to an object struck by the shoe in such manner so as to impart to the struck object applying the load some portion of the energy produced by the applied load; the horizontal and vertical components can be made of one type of material or of a composite of one or more type of materials. For example, these components can be made of a laminate of one or more type of materials. The performance enhancing shoe components can have one or more shapes in one or more locations within the outsole shoe component depending upon the particular performance enhancing characteristics desired by the wearer. The vertical component of embodiments of the present invention may rest directly upon the horizontal component within the shoe outsole, or it may rest upon the shoe midsole or insole, so long as it is directly above the horizontal component of embodiments of the present invention.

The present invention includes a performance enhancing soccer shoe component for a soccer shoe which comprises a shoe upper and at least two soles, one of which is the outsole secured to the upper and a midsole which is located between the wearer's foot and the outsole. This midsole can incorporate one or more preformed objects, the horizontal components of embodiments of the present invention, embedded in the midsole material, or the horizontal component can constitute the entire midsole, and it also operates to deflect, without permanent deformation. This midsole can be added as part of the manufacturing process of the new shoe. This performance enhancing shoe component can include a midsole made of one type of material; alternatively, the midsole can be a composite of one or more type of materials—in such a case, it could be made of a laminate of one or more type of materials. The horizontal component can have one or more shapes in one or more locations within the midsole depending upon the particular performance enhancing characteristics desired by the wearer. The vertical component of embodiments of the present invention may rest directly upon the horizontal component within the midsole, or the vertical component may rest directly upon an insole, and directly above the horizontal component within the midsole.

The embodiments of the present invention include a performance enhancing soccer shoe insert which can be placed between the outsole and/or midsole and the wearer's foot. This inserted insole can contain one or more preformed objects, the horizontal components of embodiments of the present invention, embedded in the insole material, or the insert can constitute the entire insole, and it also operates in a manner consistent with previously described embodiments of the invention. This "after market" inserted insole can be added after the shoe has been manufactured and sold. The insole can be made of one type of material, or it can be made of a composite of one or more type of materials, in which case it could be made of a laminate of one or more type of materials. The components in the insole can have one or more shapes in one or more locations within the shoe insert depending upon the particular performance characteristics desired by the wearer. The vertical components of embodiments of the present invention will rest directly upon, or above the horizontal component of the insole.

Prototypes of the horizontal component were made and tested. The prototypes consisted of split fishing rods, made of combinations of fiberglass and graphite, then glued together. The glued together split fishing rods were shaped and inserted into soccer shoes for testing. The horizontal components alone increased the distance of soccer balls kicked when compared to the distance of soccer balls kicked without the horizontal insert.

The rubber toe outsole of a tennis shoe was then glued directly upon the horizontal split fishing rods component, and this was inserted into a soccer shoe. The addition of this vertical component not only increased the distance of a kicked soccer ball, it also felt dramatically different at the moment the shoe struck the ball. The wearer of the shoe felt less strain in the knee, ankle and foot than was felt with just the horizontal component inserted into the shoe. The kicked ball seemed to travel further and fly faster with less effort. The ease of effort and reduction of discomfort was more noticeable when the weather was colder. In cold weather, striking a soccer ball with the top of the shoe directly above the toes can be painful. The same kick in cold weather, with the vertical component inserted in the soccer shoe, is much more comfortable. The vertical component of the present invention makes contact with the ball, and absorbs some of the energy of the kick, before the kicked ball makes contact with the toes.

The vertical component will be located beyond and above the toes, then extend laterally back towards the heel and along both sides of the toes and forefoot. The portion of the vertical component along both the inside or outside of the foot, will also serve to transfer energy to a ball kicked by either the inside or the outside of the shoe. When a ball is struck with either the inside or the outside of the foot, the vertical component will cause the horizontal component to bend and twist to a greater extent than would be possible with just the horizontal component. The energy produced by the ball strike would be more efficiently transmitted to the ball than would be possible without the vertical component. Since the horizontal component is flat or slightly curved, it can be twisted by a force applied on the outside edges of the horizontal component. Upon release of the force applied on the outside edge, the horizontal component will untwist, and the energy produced by this untwisting motion can be transferred to the object struck.

During the course of a soccer game, there are instances where a player wishes to impart spin to a struck ball in order to curve the ball around or away from opponents. In order to impart spin to a ball, the ball must be struck off of its center and/or the ball must be struck by the side of the shoe. The greater the amount of spin the greater the ball will curve. The vertical element located along the outside of the of the toes and extending laterally towards the heel will allow ball strikers to impart more spin to the object struck than would be possible without the vertical component.

The present invention also includes a soccer shoe including the component or the insert of any embodiment of the present invention.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
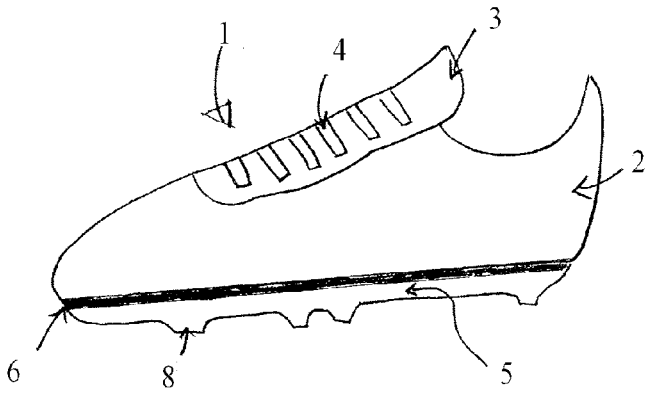
FIG. 1 is a side view of a preferred embodiment of the apparatus of the present invention.

The athletic shoe shown for illustrative purposes is a soccer shoe even though the present invention may be used in other types of athletic or any other type of shoe. The soccer shoe shown in FIG. 1 is of generally conventional form. The shoe 1 has an upper 2 made of leather or similar material, with a tongue 3 and laces 4. The shoe FIG. 1 has an outsole 5 and a midsole 6 either or both of which may incorporate the horizontal component of an embodiment of the present invention. The vertical component of an embodiment of the present invention will preferably be resting upon, or be immediately above, the horizontal component, regardless of whether the horizontal component is located in the midsole 6 or outsole 5. The outsole 5 also incorporates molded or screw threaded studs or cleats 8 which come in contact with the ground when the shoe 1 is worn.

Figure 2:
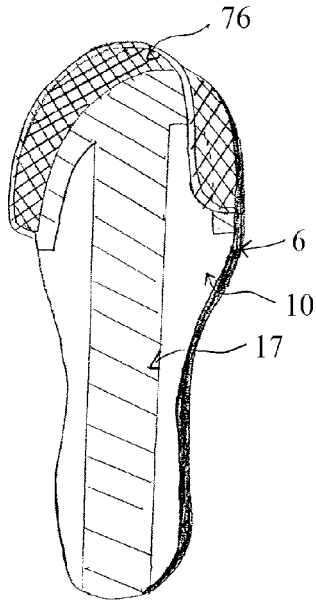
FIG. 2 is a top view of a preferred embodiment of the apparatus of the present invention.

FIG. 2 is a top view of a shoe midsole 6 with an illustration of the horizontal component 7 illustrated by the striped lines, and the vertical component 76 illustrated by the cross hatched lines, of an embodiment of the present invention. This midsole 6 is worn between the foot and the outsole. The material 10 surrounding the shoe midsole of an embodiment of the present invention may consist of air, gas, foam rubber or other cushioning material.

Figure 3:
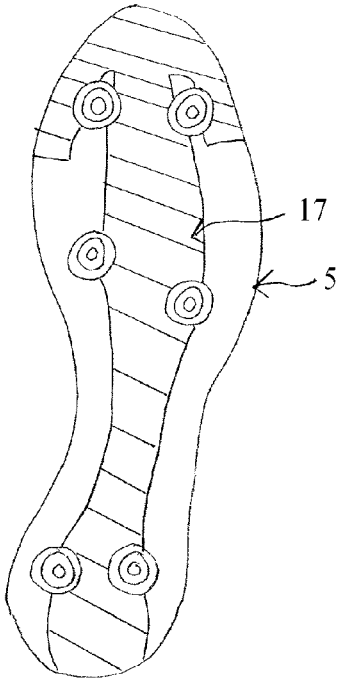
FIG. 3 is a bottom view of a preferred embodiment of the apparatus of the present invention.

FIG. 3 is a bottom view of a shoe outsole 5 illustrating the horizontal component 17 of an embodiment of the present invention embedded in the outsole 5 (outsole 5 can be made of the same material typically for soccer shoe outsoles).

Figure 4:
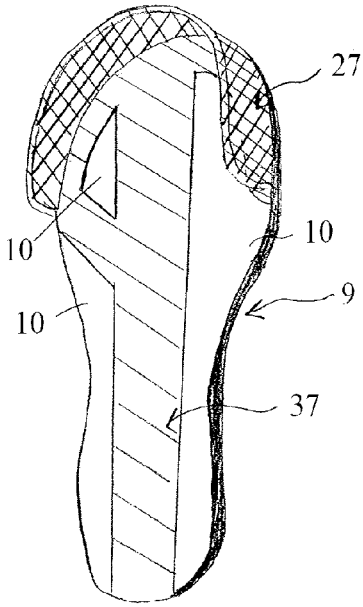
FIG. 4 is a top view of a preferred embodiment of the apparatus of the present invention.

FIG. 4 is a top view of a shoe insole insert 9 including the vertical component 27, illustrated by the cross hatched lines, of an embodiment of the present invention resting directly upon or immediately above the horizontal component 37 of an embodiment of the present invention, illustrated by the striped lines. Insert 9 can be inserted in an otherwise standard soccer shoe after the shoe is manufactured and purchased.

Figure 5:
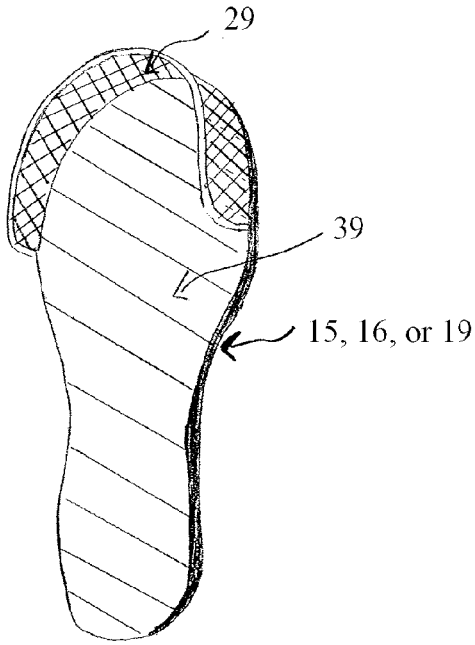
FIG. 5 is a top or bottom view of a midsole or inserted insole illustrating an embodiment of the present invention as the entire outsole midsole or insole.
Figure 6:
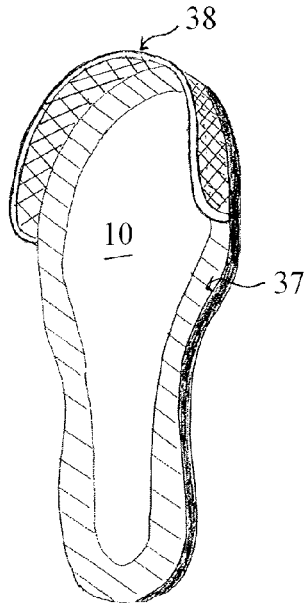
FIGS. 6, 7, 8, 9, 10 are top views of the outsole/midsole/insole insert illustrating alternative embodiments of the present invention.
Figure 7:
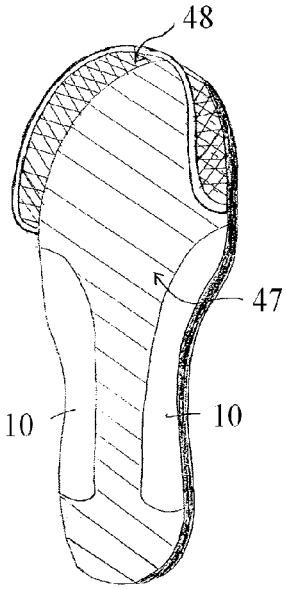
Figure 8:
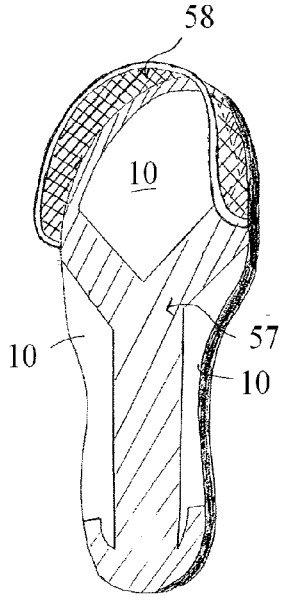
Figure 9:
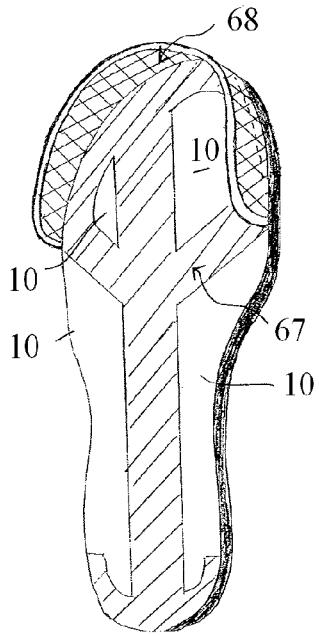
Figure 10:
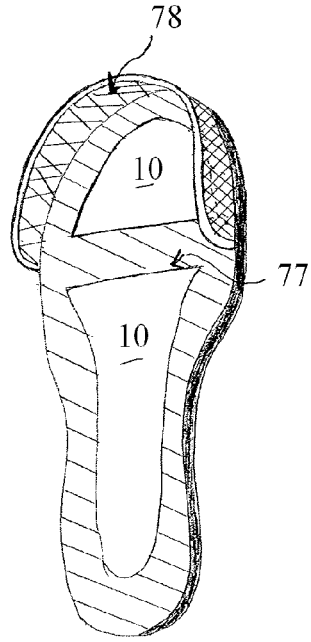

FIG. 5 is a top view of an outsole 15, a midsole 16, or an inserted insole 19 illustrating an embodiment of the present invention where the entire outsole 15, midsole 16 or insole 19 is the horizontal component and is illustrated by the striped lines, and the vertical component 29, is illustrated by the cross hatched lines.

Figure 15:
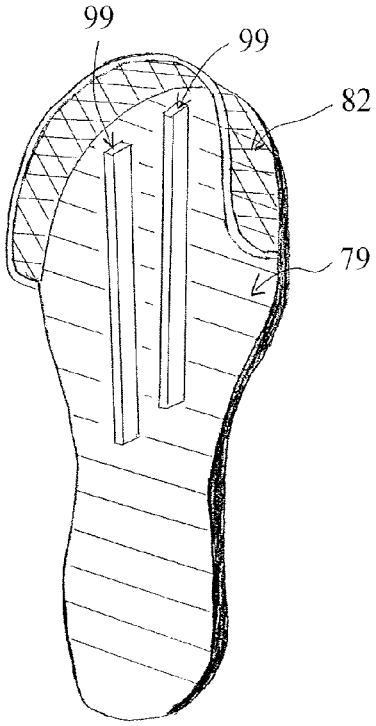
FIGS. 15, 16 and 17 are top views of the outsole/midsole/insole insert illustrating alternative embodiments of the present invention.
Figure 16:
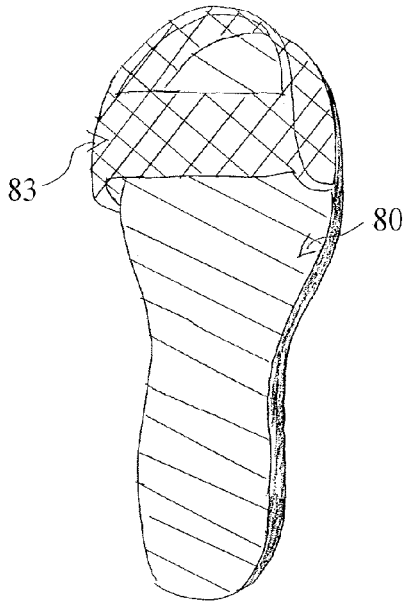
Figure 17:
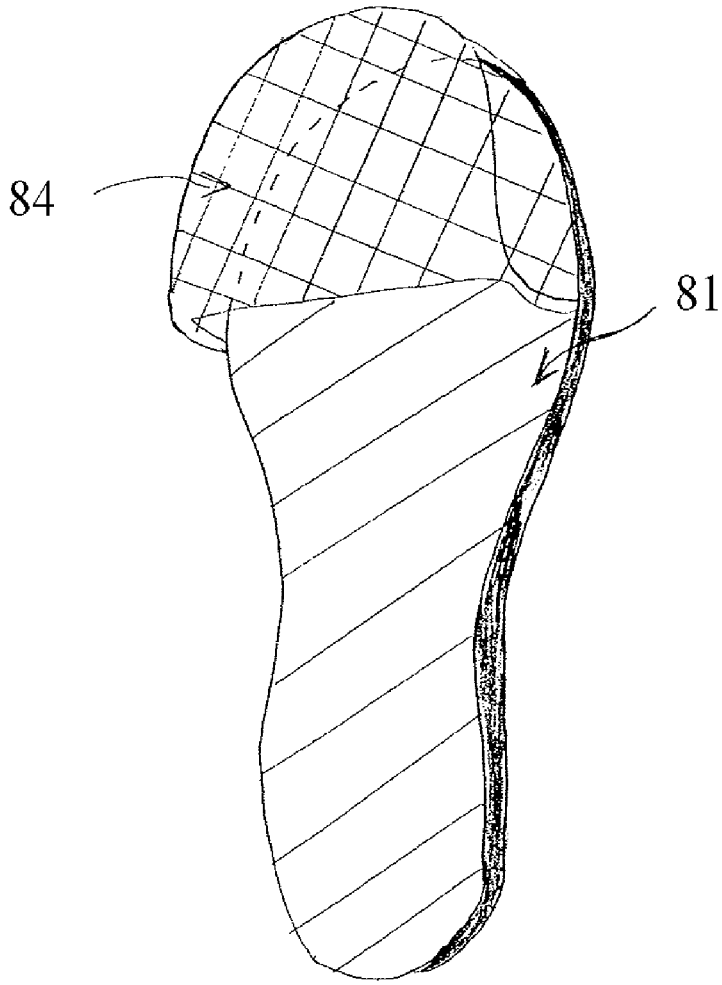

FIGS. 6, 7, 8, 9, 10, 15, 16 and 17 are top views of the outsole/midsole/insole insert illustrating the horizontal component 37, 47, 57, 67, 77, 79, 80 and 81 of alternative embodiments of the present invention, which are illustrated by the striped lines. The vertical component 38, 48, 58, 68, 78, 82, 83 and 85 of embodiments of the present invention will preferably rest upon or directly above the toe end of the horizontal components. The vertical components of embodiments of the present invention are illustrated by the cross-hatched lines. In FIG. 16 the vertical component 83 of alternative embodiments of the present invention forms a partial cap over the top of the fore foot within the shoe. In FIG. 17 the vertical component 84 of alternative embodiments of the present invention forms a full cap over the fore foot and toes within the shoe.

Figure 11:
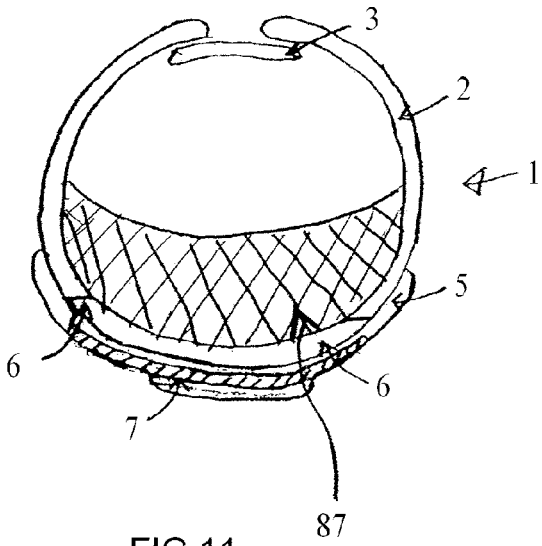
FIG. 11 is a cross section of a toe of a soccer shoe showing the shoe and an embodiment of the present invention located within the shoe outsole.

FIG. 11 is a cross section of the toe of shoe 1 showing the shoe upper 2 and the vertical component 87 of an embodiment of the present invention located at the extreme end of the toe of the shoe and located directly above the shoe outsole 5, which contains the horizontal component 7 of the shoe.

Figure 12:
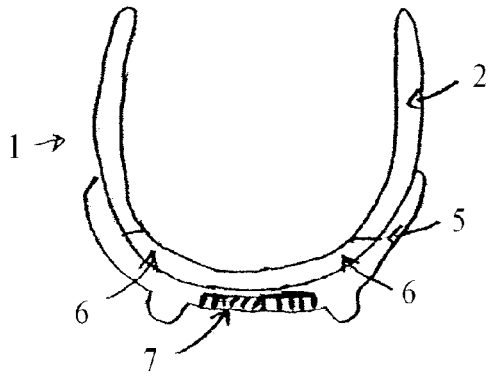
FIG. 12 is a cross section of the heel of a shoe and an embodiment of the present invention located within the outsole.

FIG. 12 is a cross section of the heel of the shoe 1 and component 7 of an embodiment of the present invention (or any other component shown in FIGS. 2-10) located within the shoe outsole 5.

Figure 13:
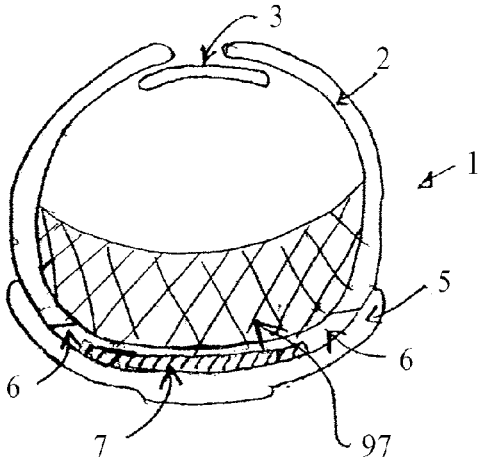
FIG. 13 is a cross section of a toe of a shoe showing an embodiment of the present invention of the present invention located within the midsole of the shoe.

FIG. 13 is a cross section of the toe of a shoe 1 showing the vertical component 97 of an embodiment of the present invention located at the extreme end of the toe of the shoe and resting upon the midsole 6 of the shoe, which contains the horizontal component 7.

Figure 14:
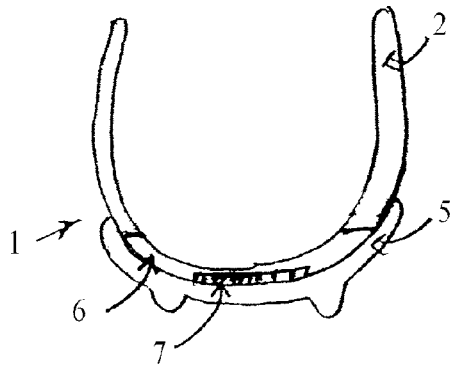
FIG. 14 is a cross section of the heel of a shoe showing an embodiment of the present invention located within the midsole of the shoe.

FIG. 14 is a cross section of the heel of the shoe 1 showing component 7 of an embodiment of the present invention (or any other component shown in FIGS. 2-10) within the midsole 6 of the shoe.

FIGS. 13 and 14 may also be used to illustrate a cross section of an embodiment of the present invention located within an insole inserted into the shoe.

FIG. 15 is a top view of the outsole/midsole/insole insert illustrating an alternative embodiment of the present invention showing a channel 99 located within the outsole/midsole/insole insert. This channel may be rectangular, as shown, or circular, semi-circular, round, triangular or oval. The number of these channels and their placement or alignment may vary. The purpose of this channel is to allow the wearer of the shoe to customize the performance characteristics of the horizontal component. Shaped bars or rods, etc. of material or materials in composite and/or laminate construction with varying flex, resilience and rebound characteristics may be put into these channels and easily removed or replaced. These materials may be chosen from those used to make the horizontal components of the present invention, though in a given shoe may be made of a different material from the horizontal components used in that shoe.

In the drawings the horizontal component of the shoe sole/insert of the present invention is shown in striped lines and the vertical component of the shoe/sole/insert of the present invention is shown in cross hatched lines, whether located in the outsole, midsole, or as part of an inserted insole. The horizontal and/or the vertical components of the present invention can be manufactured into the outsole and/or the midsole. If the component is manufactured into the outsole, the material may be a color different from the outsole. This different color would be desirable to distinguish the shoe from shoes without the components of the present invention in the outsole. The insert of an embodiment of the present invention may also be incorporated into an innersole, which is inserted into the shoe at some point after the manufacture of the other components of the shoe.

The shoe sole/insert of an embodiment of the present invention can be made of one material, or of a combination of natural and/or man-made materials. The choice of material or combination of materials, the shape of the materials, and the location of the component within the shoe can be determined by the wearer's desire to optimize specific performance enhancing characteristics of the shoe. The primary specific characteristic of the shoe sole/insert of the present invention is to efficiently return energy that would be wasted without the shoe sole/insert of the present invention. In response to an applied load, such as kicking a ball or striking the ground, the shoe sole/insert of the present invention will temporarily deform. Upon removal of the applied load, or a progressive reduction of the applied load, the shoe sole/insert of the present invention will return to its original shape. This absorption of energy and the return of otherwise wasted energy to the wearer and/or to the object struck by the shoe of the wearer is the essential performance enhancing characteristic of the present invention. Other applications of the present invention may include lighter weight, more comfort, less fatigue, more stability, less injury risk, better foot control, better foot support, or even better outward appearance of the shoe.

The shoe sole/insert of an embodiment of the present invention should have a relatively high tensile strength. The material or materials should also be elastic and have a strong tendency to return to an unstressed state once it is free from the stress of impact. The material or materials should also possess good fatigue resistance so that it will withstand repeated cycles of deforming when stressed and rebounding when the stress is removed. The material or materials may be a composite or be laminated in order to achieve desired combinations of the specific applications of the shoe. The material should have a modulus of elasticity of at least 250,000 psi. Typical materials are high modulus plastics such as polycarbonate materials (modulus of 300,000), ABS injected molded plastic, fiberglass composites (modulus of 3,000,000), graphite composites (modulus of 9,000,000), carbon composites, and various types of steel. The material or materials in the vertical component may have entirely different characteristics than the material or materials used in the horizontal components of embodiments of the present invention.

The shoe sole/insert of the present invention should be lightweight and thin. The thickness may be constant or may vary depending upon the desires and the intended use of the wearer. The cross sectional thickness of the present invention will vary, dependent upon the material used and the wearer's desires, but the thickness of the horizontal component is preferably in the range of 0.10-1.0 cm. The thickness of the vertical component is preferably in the range of 0.25 cm-0.80 cm. The shoe sole/insert of the present invention may also be hollow. The horizontal component of the shoe sole/insert of the present invention may extend the length of the foot, it may be shorter or longer than the foot, or extend beyond or over the heel and/or toes of the foot. The vertical component of the shoe/sole/insert of the present invention will rest upon or be placed directly above the horizontal component and will be located beyond and over the toes of the foot. The components of the shoe sole/insert of the present invention may be flat or round and/or any shape or combination of shapes, the surface may be flat, curved, grooved or corrugated. The shoe sole/insert of the present invention may consist of one or more parts, which may be connected or function independent of each other.

The shoe sole/insert of an embodiment of the present invention may be incorporated into the outsole and/or midsole and/or insole during the manufacturing process. The manufacturer may also leave a pocket or space in the outsole and/or midsole and/or insole for a separately manufactured component of the present invention. This would allow individual choice of a variety of materials or shapes in the wearer's discretion. The same shoe may then be able to accommodate a broad range of stiffer or more flexible shapes so that the wearer can snap the desired component into the pocket or space, then remove it at will, and snap in another variant of the component as desired.

While the foregoing description has referred particularly to soles for soccer shoes (and is preferably used with soccer shoes), the invention is also applicable to articles of footwear, whether athletic footwear or not, and both with and without studs. For example, the invention can be applied to casual or dress shoes, to tennis shoes and training shoes.

All measurements disclosed herein are at standard temperature and pressure, at sea level on Earth, unless indicated otherwise. All materials used, or intended to be used in a human being are biocompatible, unless indicated otherwise.

The foregoing embodiments are presented by way of example only; the scope of the present invention is to be limited only by the following claims.

I claim as my invention:

1. A soccer shoe, comprising:

a) a shoe body having a shoe upper and an outer sole secured to the upper so that a wearer's foot can be positioned within the upper and above the sole, the sole having a lower surface with cleats and an upper surface, the shoe having a front with a toe box and a periphery that extends at the front around the toe box, a middle, a back, and a heel;

b) an inner sole layered above the outer sole in between the outer sole and the upper, the cleats not contacting the inner sole;

c) a component extending vertically upward in the front of the shoe, the component extending vertically from the inner sole and continuously along the periphery of the inner sole within the toe box of the upper and rearwardly on opposing sides of the inner sole, the component terminating at a mid sole area of the inner sole;

d) the component stiffening the toe box so that the component is able to deflect, without permanent deformation, in response to an applied load creating a deflecting stress and then to return to its original shape upon removal of the applied load causing the deflecting stress, the component operating to absorb, redistribute and store the energy of localized loads applied thereto through deflection and, by returning to its original shape, to return energy to an object struck by the shoe in such manner so as to impart to the struck object applying the load some portion of the energy produced by the applied load.

2. The shoe of claim 1, wherein the component is made of only one type of material.

3. The shoe of claim 1, wherein the component is made of a composite of one or more types of material.

4. The shoe of claim 1, wherein the component is made of a laminate of one or more types of material.

5. The shoe of claim 1, wherein the component is made of a material from the group consisting of: graphite, carbon, kevlar, fiberglass, titanium, metal, metal alloys, composite, laminate.

6. The shoe of claim 1, wherein the vertical portion of the component is made of a material from a natural or synthetic rubber compound.

7. The shoe of claim 1, wherein the vertical portion of the component is made of a material from the group consisting of 1,2-polybutadiene, 1,4-polybutadiene, synthetic isoprene rubber, natural rubber, polyisoprene, butadiene acrylonitrile rubber, ethylenepropylene diene modified rubber, styrene butadiene rubber, thermoplastic elastomers, and plastics such as polystyrene, ethylene vinyl acetate, polyvinyl chloride, and combinations thereof.

8. The shoe of claim 1, wherein the vertical portion of the component or insert is at least 50% as high as the front of the shoe upper.

9. The shoe of claim 1, wherein the vertical portion of the component or insert is at least 75% as high as the front of the shoe upper.

10. The shoe of claim 1, wherein the vertical portion of the component or insert is at least 90% as high as the front of the shoe upper.

11. The shoe of claim 1, wherein the component transmits deflecting stress to the inner and/or outer sole, both the component and inner and/or outer sole operating to absorb, redistribute and store the energy of localized loads applied thereto through deflection and, by both the component and the inner and/or outer sole returning to their original shape, to return energy to an object struck by the shoe in such manner so as to impart to the struck object applying the load some portion of the energy produced by the applied load.

12. The shoe of claim 1, wherein the component is an integral part of a system where the outer sole and/or the inner sole have carbon/graphite fibers (or other materials or laminates) contained therein which are maximally flexed when the component is present.

13. A soccer shoe, comprising:

a) a soccer shoe body having a shoe upper, a cleated outer sole secured to the upper, enabling a wearer's foot to be positioned within the upper and above the outer sole, b) an inner sole located between the wearer's foot and the outer sole, the shoe body having a front with a toe box, a periphery, a middle, a back, and a heel, and cleats on the outer sole not extending to the inner sole;

c) the inner sole including a component extending vertically upward at least in the front of the shoe and extending around the toe box, the component enabling the toe box to deflect, without permanent deformation, in response to an applied load creating a deflecting stress.

14. The shoe of claim 13, wherein the component is made of a composite of one or more types of material.

15. The shoe of claim 13, wherein the component is made of a laminate of one or more types of material.

16. A soccer shoe, comprising:

a) a soccer shoe body having a shoe upper and an outer sole having downwardly extending cleats and secured to the upper such that a wearer's foot can be positioned within the upper and above the outer sole, the shoe having a front with a toe box, a periphery of the front, a middle, a back, and a heel;

b) an inner sole above the outer sole, cleats on the outer sole not extending to the inner sole;

c) an insert with a forward section extending vertically upward in the toe box of the shoe, the insert enabling deflection without permanent deformation, in response to an applied load creating a deflecting stress and then to return to its original shape upon removal of the applied load causing the deflecting stress.

17. The shoe of claim 16, wherein the insert is added after the shoe has been manufactured and sold.

18. The shoe of claim 17, wherein the insert is made of a composite of one or more types of material.

19. The shoe of claim 16, wherein the insert is made of a laminate of one or more types of material.

* * * * *